US005099629A

United States Patent [19]

Gay

[11] Patent Number: 5,099,629

[45] Date of Patent: Mar. 31, 1992

[54] FULLY ENCLOSED INSULATION PACKET FOR BETWEEN FLOOR JOISTS IN BASEMENTS

[76] Inventor: Ronald K. Gay, 1026 E. 11 Mile Rd., Royal Oak, Mich. 48067

[21] Appl. No.: 585,955

[22] Filed: Sep. 21, 1990

[51] Int. Cl.[5] ..... E04B 2/16

[52] U.S. Cl. ..... 52/406; 52/100; 428/43

[58] Field of Search ..... 52/100, 406, 407, 309.6, 52/404, 232, 452; 428/43

[56] References Cited

U.S. PATENT DOCUMENTS

| | | | |
|---|---|---|---|
| 1,797,228 | 11/1928 | Fitter | 52/407 |
| 2,817,123 | 3/1955 | Jacobs | 52/406 |
| 3,264,165 | 11/1964 | Strickel | 52/309.6 |
| 4,569,174 | 2/1986 | Bossamy | 52/406 |
| 4,653,241 | 3/1987 | Bindi | 52/404 |

FOREIGN PATENT DOCUMENTS

| | | | |
|---|---|---|---|
| 0114687 | 1/1984 | European Pat. Off. | 52/406 |

*Primary Examiner*—David A. Scherbel
*Assistant Examiner*—Kien Nguyen
*Attorney, Agent, or Firm*—Lynn E. Cargill

[57] ABSTRACT

A thermal insulation packet for fitting into the space above a basement wall between floor joists adjacent the outside wall of a building structure includes a substantially enclosed, discrete packet containing a body of insulation material. The insulation packet is sized to fit in a space defined, on the bottom, by the top of the basement wall, on the sides, by a first floor joist and an immediately consecutive second floor joist and, in the back, by the outside wall of the building structure. The thermal insulation packet is also capable of being installed by an installer without physically contacting the body of insulation material contained with the packet.

11 Claims, 1 Drawing Sheet

FULLY ENCLOSED INSULATION PACKET FOR BETWEEN FLOOR JOISTS IN BASEMENTS

TECHNICAL FIELD

This invention relates to home insulation. and more specifically relates to an insulation packet for use on top of a basement wall between floor joists.

BACKGROUND OF THE INVENTION

In the construction of homes, insulation is added between the walls and above the ceiling in order to render the home more energy efficient. In the past, building codes have been applied for various insulation applications in order to prevent heat loss from the building.

Therefore, it has been known in the art that the conservation of fuel used for heating building structures can be substantially increased where the structures are assembled with adequate insulation. As is also known, in both remodeled and new building structures, the use of insulation in particular areas has not been easily accessible, as well as remaining uninsulated due to unavailability of particular insulating materials which may be installed without physical contact to the installer.

It is also known that the insulation materials which are currently being used in building structures, including fiberglass and the like, create toxicity problems for the installers of the installation who come in direct physical contact with the insulation material, as well as the residents of the building structure who receive peripheral exposure to the insulation materials themselves. In the insulation field, it has been widely recognized that physical contact with fiberglass is undesirable due to its extremely toxic effect. Out-gassing of other insulation materials make them unsuitable for the building structure residents as the fumes given off by the outgassing insulation is also toxic. For these reasons, it would be advantageous for various insulation applications which have traditionally remained uninsulated, to include a new type of insulation which would allow the application of insulation without physical contact by the installer, and an insulation package which would act to contain any of the insulation material fibers and/or fumes which may be toxic to the building structure residents.

One particular heat loss area in a home which has been traditionally ignored is the space between the top of the basement wall and the outside wall of the building structure between the floor joists. Considerable heat is lost to the outer elements in this manner because there has traditionally been no insulation, with only the outside wall board to prevent the loss of heat therefrom. In the past, pieces of ceiling or wall insulation have merely been cut to shape, and jammed into the space, leaving the installer in full physical contact with fiberglass, and an open exposure to the fibers to the building structure residents.

It would be advantageous to be able to purchase an insulation package which would fit into that space above the basement wall which would: (1) be an enclosed sealed package, (2) fit into the space at the top of the basement wall between floor joists and the outside wall of the home; (3) be capable of being filled with virtually any type or variety of insulation material, including stable and non-gassing type materials; (4) be environmentally safe for the building structure residents after installation; and (5) be designed so that the installer will not come into direct physical contact with toxic insulation material.

Therefore, it is the primary object of the present invention to provide such an insulation package as to accommodate all of the advantages discussed hereinabove. A further object of the present invention is to provide an easy-to-install, inexpensive, environmentally safe, effective insulation packet for special application above the basement wall between floor joists and against the outside wall of the building structure.

SUMMARY OF THE INVENTION

In accordance with the present invention, a thermal insulation packet for fitting into the space above a basement wall between floor joists adjacent the outside wall of a building structure includes a substantially enclosed, discrete packet containing a body of insulation material which is sized to fit into the space defined, on the bottom, by the top of the basement wall, on the sides, by a first floor joist and an immediately consecutive second floor joist, and in the back, by the outside wall of the building structure. The thermal insulation packet should be capable of being installed by an installer without physically contacting the body of insulation material contained within the packet.

Furthermore, the thermal insulation packet should include a sealed packet such that the insulation material cannot escape from within, and is preferably sealed with an environmentally safe sealing mechanism. In another embodiment, individual pillow-like insulation packets are designed for insertion into the space above the basement wall. Yet another embodiment includes an elongated cylindrically-shaped packet suitable for wrapping around pipes in those locations where plumbing pipes are located. The packets are advantageously covered with an environmentally safe material for enclosing the insulation material, which is preferably stable and non-gassing.

In yet a particular embodiment of the present invention, the insulation packet may be between about 6 and 16 inches high, between about 6 and 16 inches deep, and between about 12 and 24 inches wide.

Depending upon the application, the insulation packet may be of a rectangular shape, or may be shaped in the form of a filled cylinder which preferably has been pinched at its ends to create a sealed container. The cylindrically-shaped packet may be pushed into the space above the basement wall in such a manner as to essentially conform to the shape of the space. The elongated version is suitable for use around pipes within the same space above the basement wall.

While the invention will be described in connection with a preferred embodiment, it will be understood that it is not intended to limit the invention to that embodiment, on the contrary, it is intended to cover many alternatives including the use of any type of insulation package material which can contain a body of insulation material as long as it fulfills the purpose of providing an easy-to-install packet for above a basement wall. Further modification and equivalents as may be included within the spirit and scope of the invention are defined by the appended claims.

DETAILED DESCRIPTION OF THE INVENTION

Figure 1:
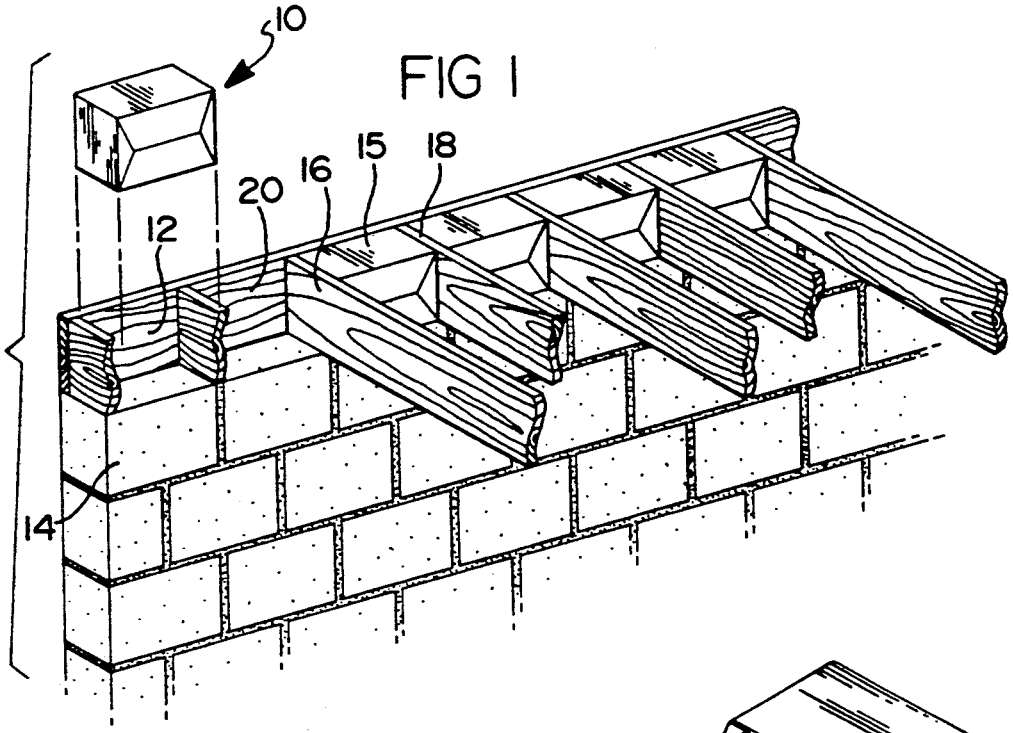
FIG. 1 is an environmental perspective view of an embodiment of the present invention in place above a basement wall.

The present invention is shown in an environmental perspective view in FIG. 1 to show placement of a thermal insulation packet as it fits into the space above a basement wall between floor joists adjacent the outside wall of a building structure. Thermal insulation packet 10 is shown as being placed up against outside wall 12 on top of basement wall 14. Insulation packet 15 is shown as a substantially enclosed, discrete packet containing a body of insulation material, and being sized to fit in a spaced defined on the bottom by the top of the basement wall 14, on the sides by a first floor joist 16 and an immediately consecutive second floor joist 18 and, in the back, by the outside wall of the building structure 12. As can be seen from the drawings, the thermal insulation packet 15 was capable of being installed by an installer without physically contacting the body of insulation material contained therein.

Figure 2:
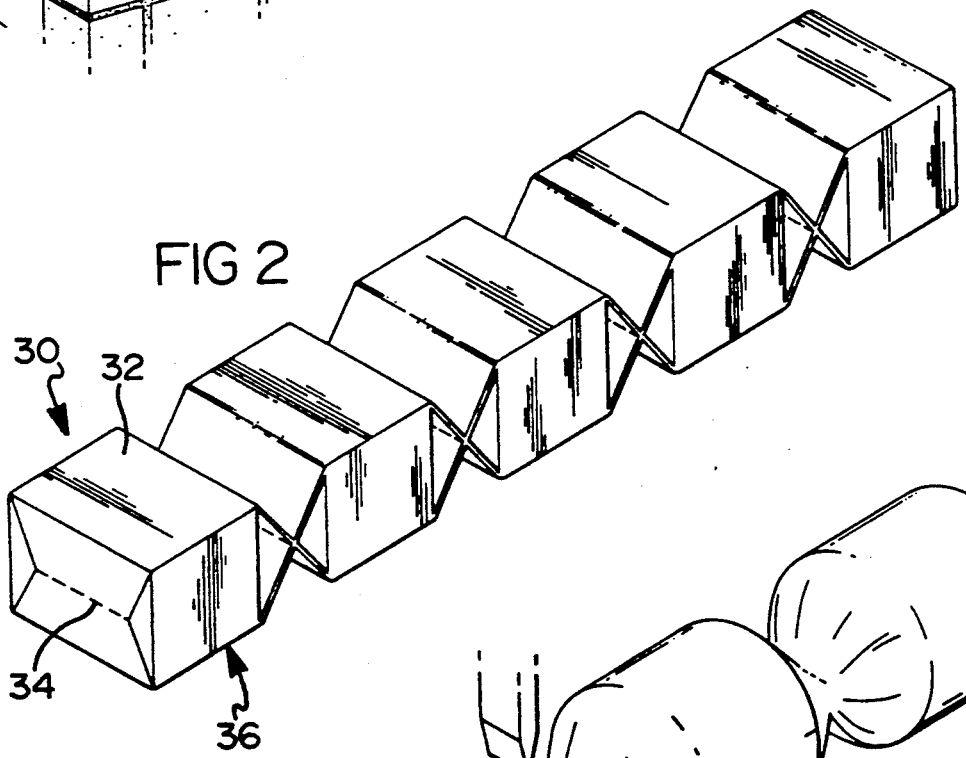
FIG. 2 is a perspective view of a series of thermal insulation packets connected in manufacturing, and before tearing apart for individual application.

Referring now to FIG. 2, a thermal insulation packet generally denoted by the numeral 30 includes a containing material 32 which surrounds a body of insulation material (not shown) and is sealed by a sealing means 34. The sealing means 34 is preferably environmentally safe, and may consist of sewing thread, thermal bonding or any other technique which is known to those of ordinary skill in the art. Although the containing material 32 should allow air to pass therethrough to permit compression for conforming to various spaces, the material should not allow insulation contained therein to escape. Even as the insulation packet may be closely shaped to the space to be insulated, some shaping will undoubtedly be necessary, and the containing material is preferably made of an air-permeable material. Thermal insulation packet 30 may be shaped into an individual pillow-like insulation packet 36 as shown in FIG. 2. The insulation packet may be between about 6 and 16 inches high, between about 6 and 16 inches deep, and between about 12 and 24 inches wide. It is envisioned that the insulation packets may be manufactured by filling a substantially rectangular shaped paper tube, and pinching and sealing in between with some sort of sealing mechanism machine.

Figure 3:
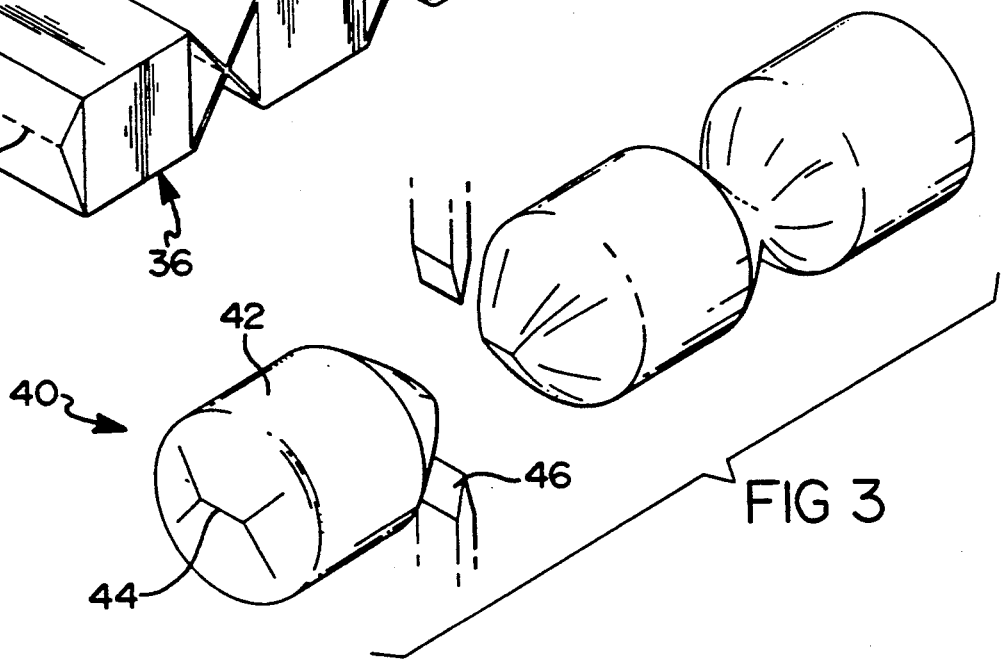
FIG. 3 shows a cylindrically shaped thermal insulation packet in a pinching operation.

Another embodiment of the thermal insulation packet is shown in FIG. 3, wherein the thermal insulation packet is generally denoted by the numeral 40. Packet 40 is substantially cylindrically-shaped and is shown as covered by a material 42 and pinched to form an enclosure at 44. Pinching mechanism 46 is shown, and may be a combination pinching, heating and bonding element for forming discrete packets of the insulation material as may be known to one of ordinary skill in the art. Insulation packet 40 can be pushed by the installer into the space above the basement wall, and essentially will conform to any shape irregularities which may be contained therein.

The insulation material which is contained within packet 40 may be filled to a greater or lesser degree, depending upon the application. If the space to be filled above the basement wall is an irregular shape, and would require more conformation by the insulation packet, then it would be most advantageous to slightly fill the interior of thermal insulation packet 40 so that it is more compliant in order to fill the space into a snug fit. There may be pipes leading to the outside of the structure located within the space above the basement wall. These pipes are not shown in the figures, although there are circumstances which are well known to those of skill in the art in which pipes are present in the space being insulated. Therefore, it is envisioned that the cylindrically-shaped insulation packet can be between about 2 to about 10 inches in diameter and elongated to a desired length so that it is capable of being fitted around the pipes or any other obstruction location with the space above the basement wall.

Thus, it is apparent that there has been provided, in accordance with the invention, a thermal insulation packet that fully satisfies the objects, aims and advantages as set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as shall fall within the spirit and broad scope of the appended claim.

I claim:

1. A thermal insulation packet for fitting into the space above a basement wall between floor joists adjacent the outside wall of a building structure, comprising:

a discrete packet containing a body of insulation material enclosed by a containing material, said discrete packet allowing air to pass therethrough, said insulation packet being sized to fit above a basement wall between floor joists adjacent the outside wall of a building structure in a space defined, on the bottom, by the top of the basement wall, on the sides, by a first floor joist and an immediately consecutive second floor joist and, in the back, by the outside wall of the building structure, and upon compression, said discrete packet can assume irregular shapes to fit into various spaces which may be contained therein, and said insulation packet being capable of being installed by an installer without physically contacting the body of insulation material contained within the packet.

2. The packet of claim 1, wherein said substantially discrete packet includes a sealed packet such that the insulation material cannot escape from within the packet.

3. The packet of claim 1, wherein said discrete enclosed packet is sealed with an environmentally safe sealing mechanism.

4. The packet of claim 1, wherein said discrete packet includes individual pillow-like insulation packets for insertion into the space above the basement wall.

5. The packet of claim 1, wherein said discrete packet includes a covering of an environmentally safe material for enclosing the body of insulation material.

6. The packet of claim 1, wherein said body of insulation material includes stable insulation material.

7. The packet of claim 1, wherein said body of insulation material includes non-gassing insulation material.

8. The packet of claim 1, wherein said insulation packet is between about 6 and 16 inches high, between about 6 and 16 inches deep, and between about 12 and 24 inches wide.

9. The packet of claim wherein said insulation packet is sized in the shape of a solid rectangle.

10. The packet of claim 1, wherein said insulation packet is shaped in the form of a filled cylinder which has been pinched at its ends to create a sealed container.

11. The packet of claim 10, wherein said filled cylinder is elongated and has a diameter of from about 2 to about 10 inches.

* * * * *